US007196972B2

(12) United States Patent
Pitocco et al.

(10) Patent No.: US 7,196,972 B2
(45) Date of Patent: Mar. 27, 2007

(54) MEDIWATCH

(76) Inventors: Theresa Ann Pitocco, 303 N. Lehigh Rd., Glassboro, NJ (US) 08028; Michelle Christina Pitocco, 526 Bridgeton Pike, Mantua, NJ (US) 08051

( * ) Notice: Subject to any disclaimer, the term of this patent is extended or adjusted under 35 U.S.C. 154(b) by 0 days.

(21) Appl. No.: 10/796,916

(22) Filed: Jul. 2, 2004

(65) Prior Publication Data

US 2006/0018200 A1 Jan. 26, 2006

(51) Int. Cl.
*G04B 47/00* (2006.01)
*A44C 13/00* (2006.01)

(52) U.S. Cl. ..... 368/10; 368/278; 63/1.11

(58) Field of Classification Search ..... 368/10, 368/278, 281, 283, 276; 221/2, 3, 15; 63/1.11, 63/1.13, 1.14, 21; 224/164–165
See application file for complete search history.

(56) References Cited

U.S. PATENT DOCUMENTS 3,739,740 A * 6/1973 Fromer ..... 116/308
4,903,250 A * 2/1990 Cho ..... 368/41
5,337,290 A * 8/1994 Ventimiglia et al. ..... 368/10
5,384,756 A * 1/1995 Pelosi ..... 368/281
5,802,014 A * 9/1998 Danko ..... 368/10
6,340,242 B1 * 1/2002 Sandidge ..... 368/278
6,464,389 B1 * 10/2002 Ghoorahoo ..... 368/278
6,560,165 B1 * 5/2003 Barker ..... 368/10
6,574,165 B2 * 6/2003 Sharma et al. ..... 368/10
6,618,328 B1 * 9/2003 Ellner et al. ..... 368/88
D496,291 S * 9/2004 Walsh, III ..... D10/32

* cited by examiner

*Primary Examiner*—Vit W. Miska

(57) ABSTRACT

Mediwatch is an alarm watch that opens into a pillbox. The face of the watch is on a hinge with a secure safety closure. There are three or four pill compartments inside the base of the watch, thus allowing the wearer to carry a full day's supply of medication. The watch will be available in four styles: wrist watch, neck watch, pocket watch, bracelet watch with two extra pill compartments.

8 Claims, 6 Drawing Sheets

WATCH FRONT

INSIDE WATCH BOTTOM (PILLBOX)

BOTTOM WATCH BACK

WATCH STYLES

MEDIWATCH

BACKGROUND OF INVENTION

Being a disabled person, as well as having to be a care giver for my disabled mother for seven years, I realized that it was always a problem remembering to take my medication or administer my mother's medication on time. Therefore, there was very often missed medication doses. Wearing the MEDIWATCH will eliminate the worry of missed medication doses because an alarm will remind you when it is time to take your medication, so that you never have to miss a medication dose. Since it is also a PILLBOX in addition to an alarm watch, it also eliminates the need to carry medication bottles or a separate medication container than can get misplaced.

In addition the back of the MEDIWATCH serves as a medical alert bracelet, with important information engraved on the back of the watch.

SUMMARY OF INVENTION

MEDIWATCH is a watch combined with a medication pillbox all in one. This watch has an alarm system that can be set for three or four alarms. These alarms will offer the choice of setting each alarm to sound of with:

1. Regular alarm buzzing or ringing
2. Voice alarm with the voice message "Time to take your medication."
3. Vibration—no audio alarm The watch face will be in regular numbers (big face) or the watch face can have Roman Numerals, providing the consumer with a choice. There is also a date window on the face of the watch.

DETAILED DESCRIPTION OF THE INVENTION

Figure 4:
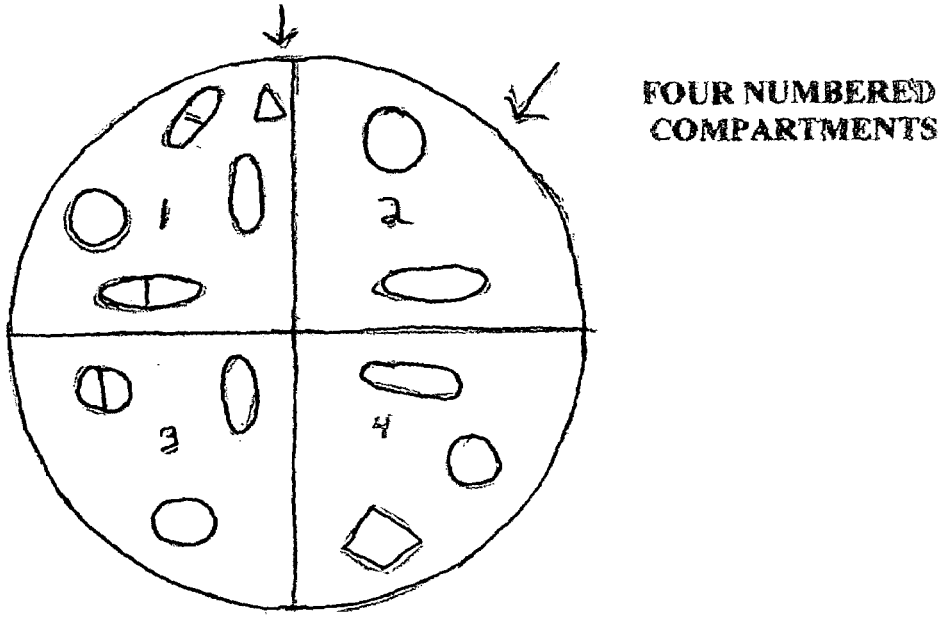
FIG. 4 shows the pillbox with four medication compartments
Figure 5:
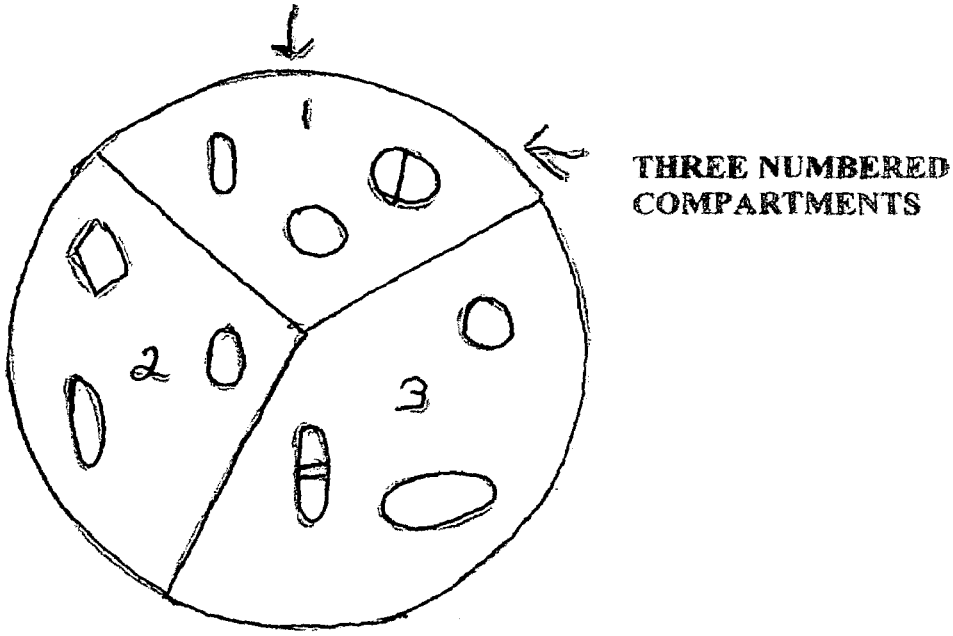
FIG. 5 shows the pillbox with three medication compartments

The MEDIWATCH will be a watch with the face of the watch on a hinge lock which when opened is a pillbox. There will be three or four separate compartments for storing medications (pills), as shown in FIGS. 4 and 5.

Figure 1:
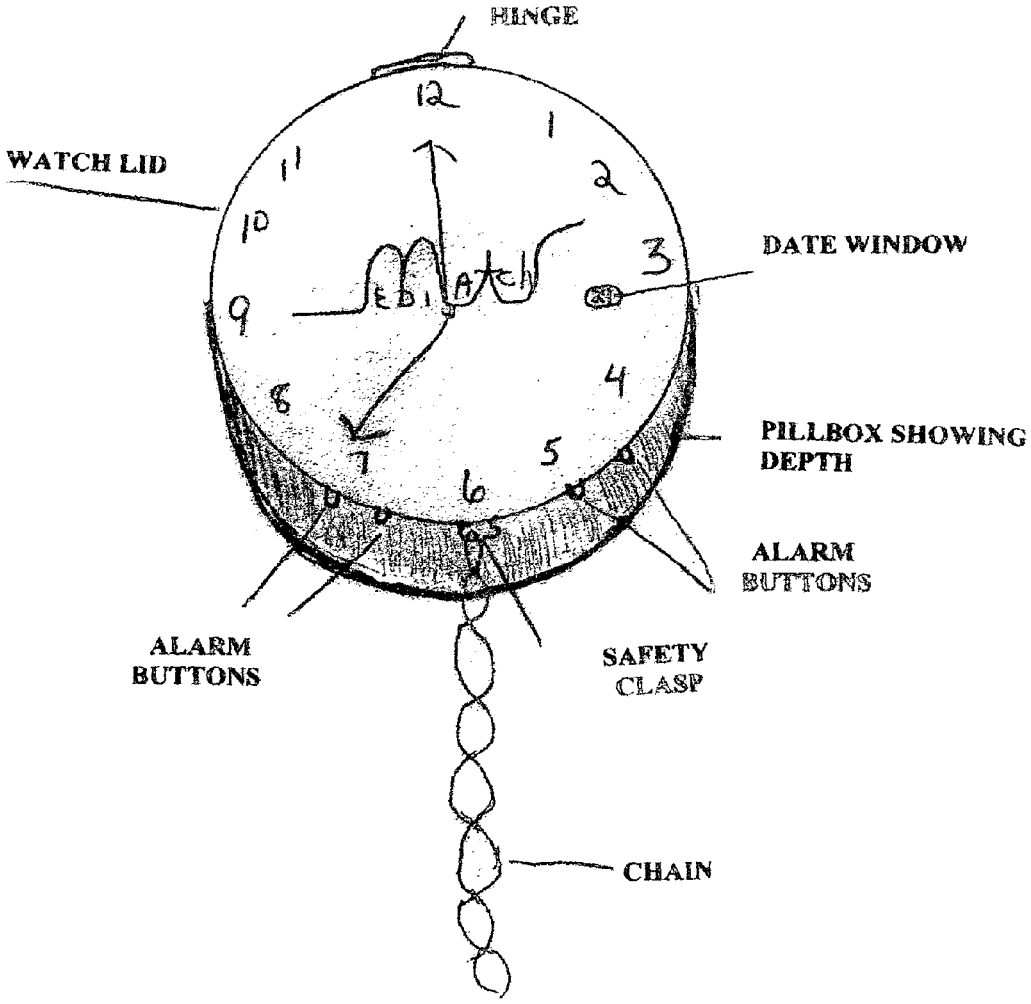
FIG. 1 shows a front view of the Mediwatch
Figure 2:
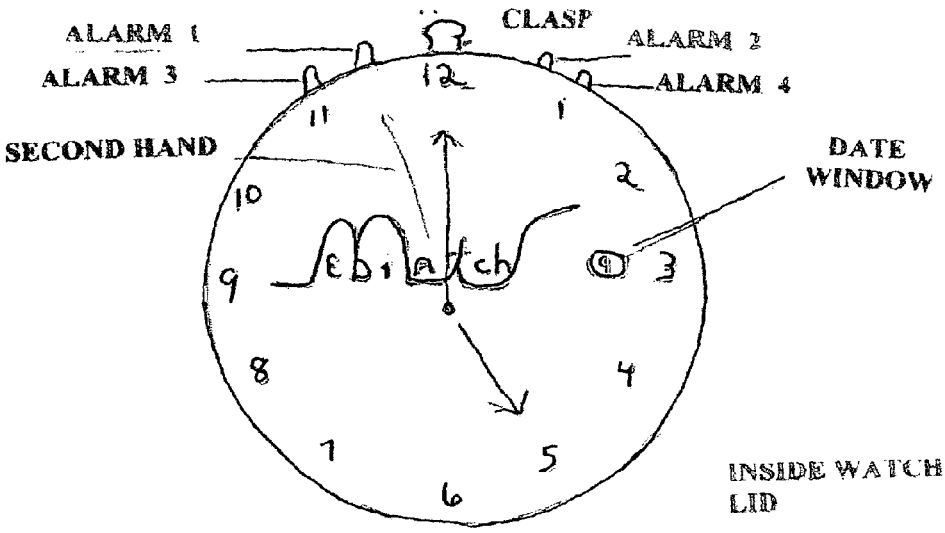
FIG. 2 shows the front of the Mediwatch with four alarm settings

Depending on the number of compartments, there will be one up to four alarms which can be set separately, as shown in FIG. 2. So throughout the day, there will be an alarm letting you know when it is time to take your medication. Each compartment will be numbered to coincide with the alarm.

Figure 3:
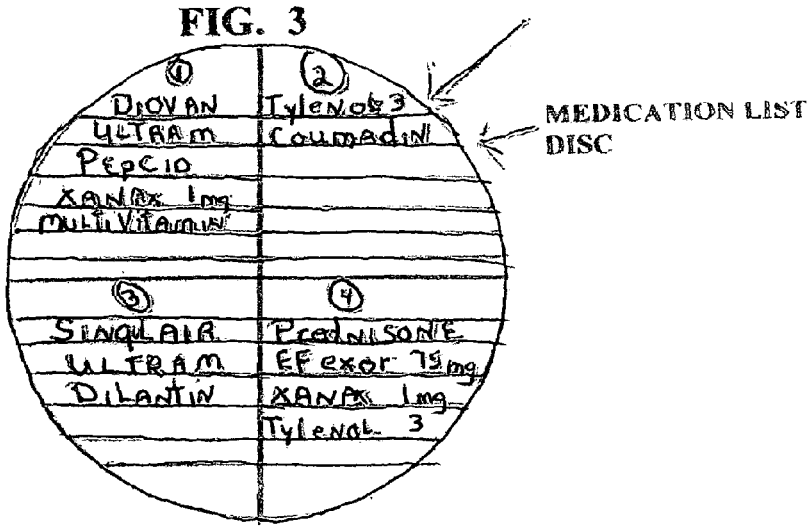
FIG. 3 shows a removable disc inside the lid

Inside the MEDIWATCH will be a removable disc on which the patient can list the medications inside the Mediwatch, as shown in FIG. 3. Any emergency personnel will automatically have available to them, the patient's medications. The Mediwatch will include six medication discs. Extra discs will be available.

Figure 6:
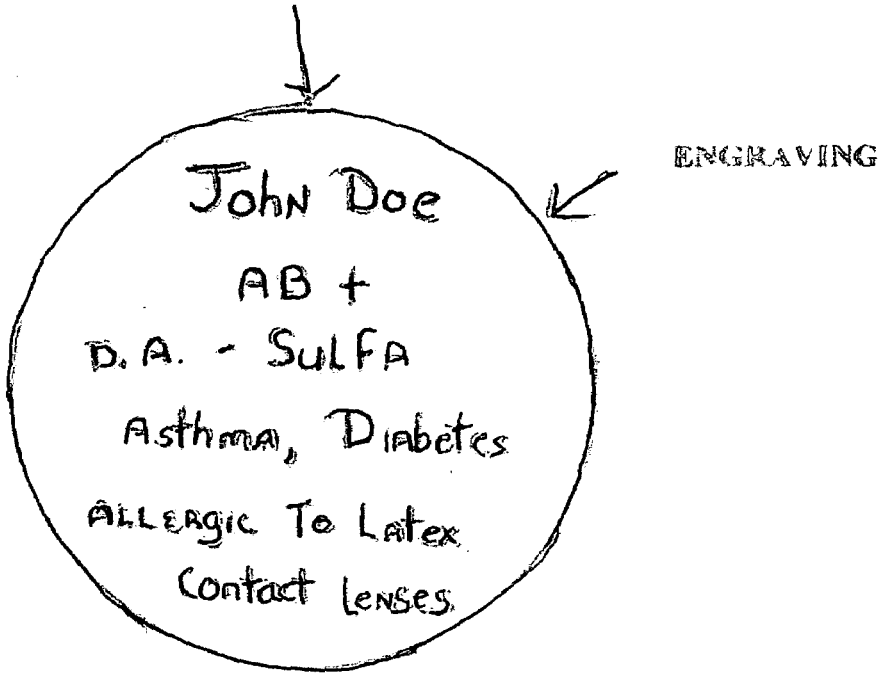
FIG. 6 shows the back of the watch with engraved information
Figure 7:
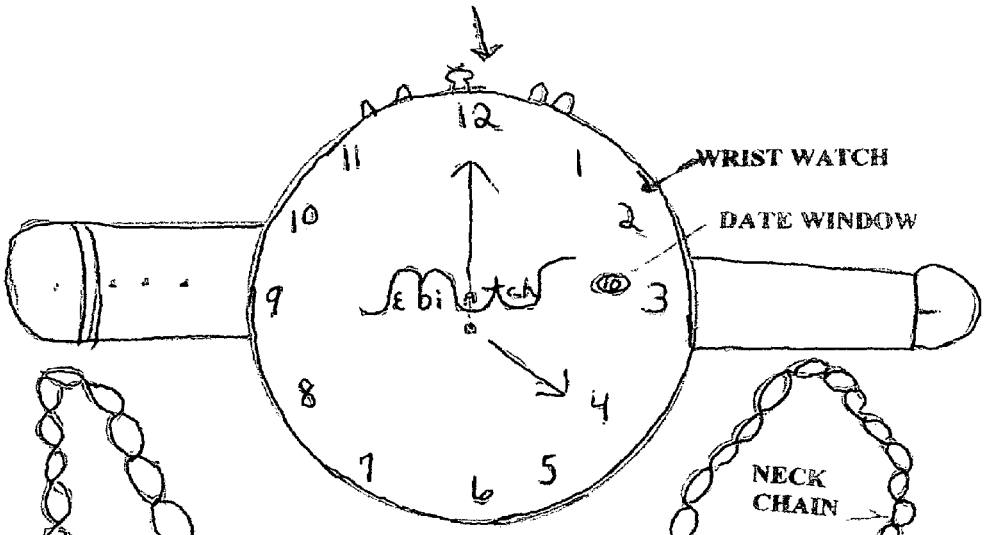
FIGS. 7–10 shows the Mediwatch constructed as a wristwatch, pocket watch, neck watch on chain and bracelet watch, respectively
Figure 8:
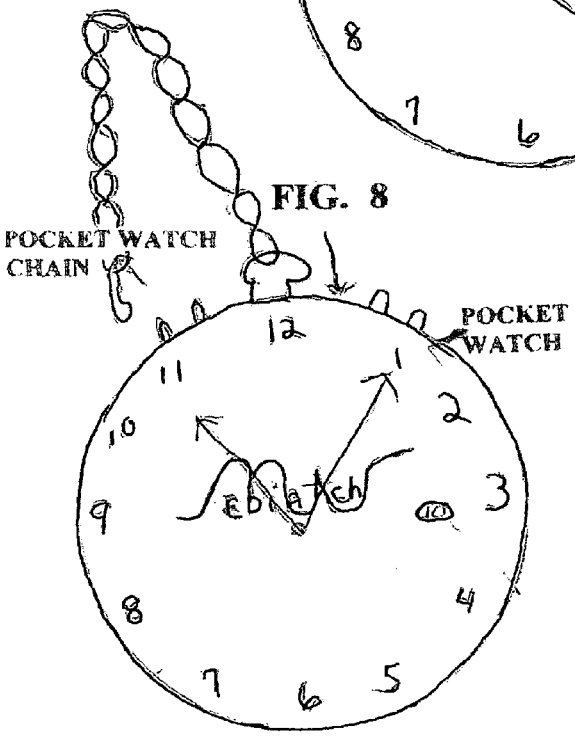
Figure 9:
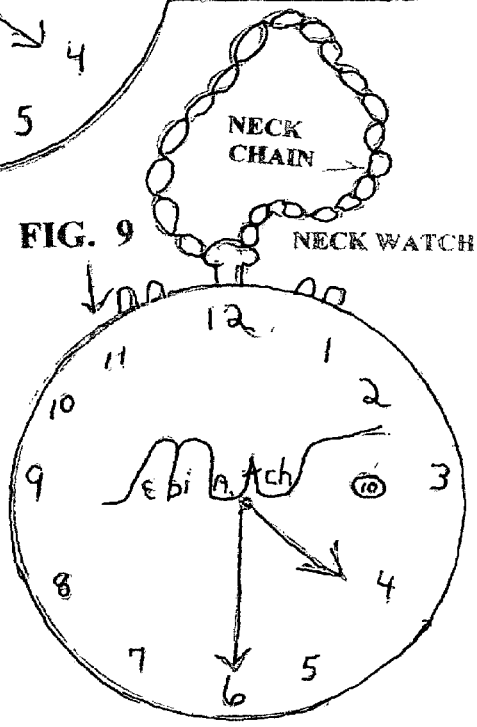
Figure 10:
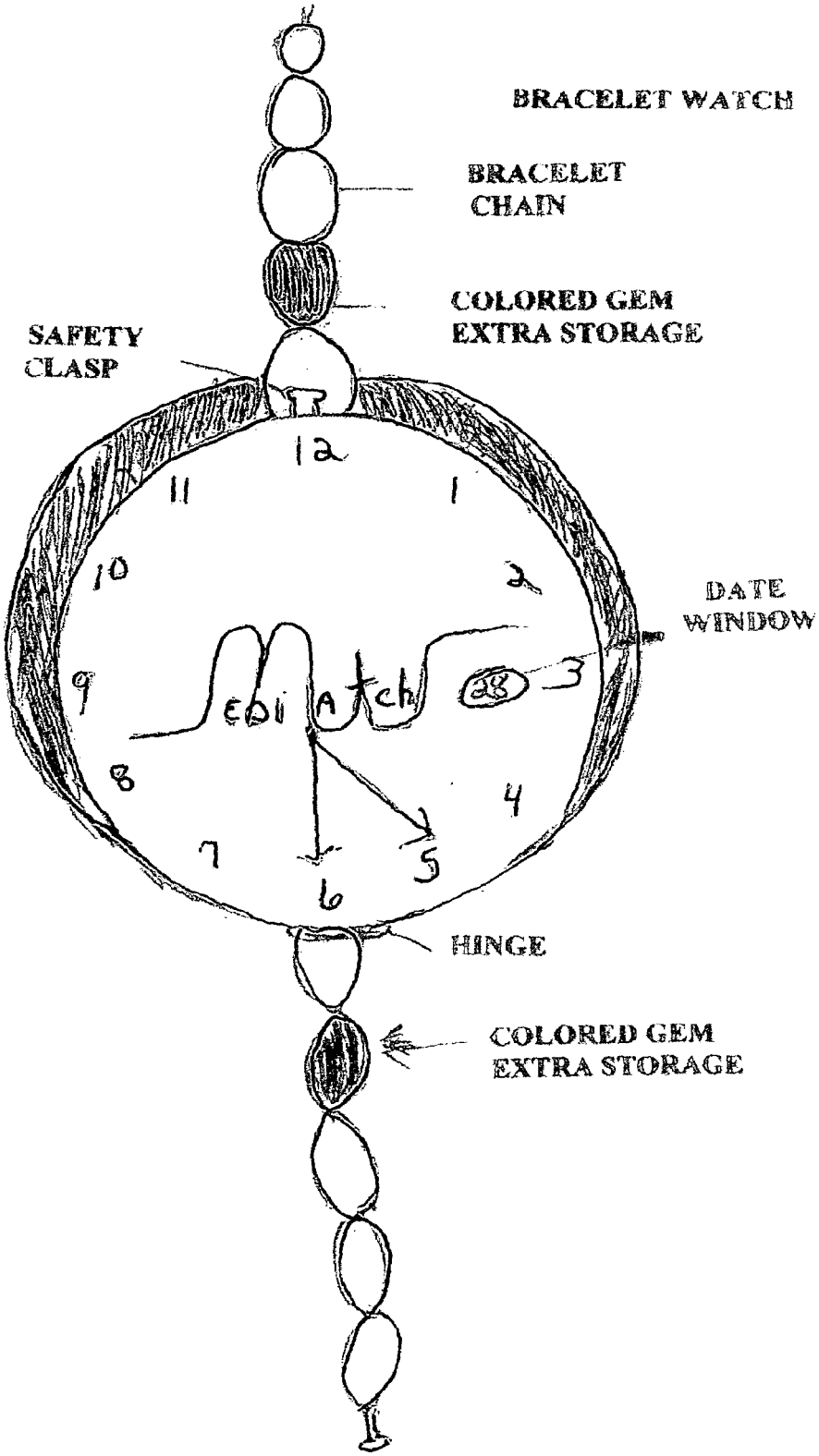

The outside back of the watch will be engraved with important medical Information, as shown in FIG. 6.

1. Patient's name
2. Patient's blood type
3. Patient's drug allergies
4. Patient's medical condition, disease or illness
5. Additional important information such as implant information

EXAMPLE

John Doe
AB+
D.A. Sulfa
ASTHMA, DIABETES
RT. EYE LENS IMPLANT, PACEMAKER

The watch will be available in four styles as shown in FIGS. 7–10.

1. Wristwatch
2. Pocket watch on a chain
3. Neck watch on a chain
4. Bracelet with two extra storage compartments on each side Never again will the patient have to fumble with medicine bottles, lost or misplaced pillboxes and most important, never will the patient forger or miss taking his/her medication at the scheduled time.

The Mediwatch will be particularly beneficial for the elderly. It will also make it much more convenient to carry your medication on you. So many times, I would prefer not to carry a handbag, pocketbook, or purse but I am forced to do so just to carry my medication. The Mediwatch will allow you to carry a full day's medication with relief from the worry of watching the clock so that a medication dose is not forgotten or missed or taken later than scheduled. The MEDIWATCH POCKET WATCH will be perfect for men. They will no longer have to bulk their pockets with medication bottles.

The Mediwatch serves three functions:

1. It is an alarm watch
2. It is a pillbox
3. it is a medical alert bracelet including a list of medications taken and important medical information about the wearer of the watch. Medical personnel and first responders will be alerted to look for the MEDIWATCH which will provide them with important medical information immediately.

The alarms will be programmed for three settings.

1. Ringing or buzzing
2. Voice Message
3. Vibration—no sound

The back of the watch will be engraved with important medical information Pertaining to the wearer of the watch, thus serving as a Medical Alert Bracelet also.

What is claimed is:

1. A watch with a pill box comprising:

a watch face having a time indicating means;

a lid adjacent the watch face;

a pill box beneath the lid comprising a plurality of compartments for medication;

means for opening the watch face for providing access to said compartments;

one or more removable disks arranged inside said lid and being provided with information about the medications therein;

a plurality of alarm setting means, each corresponding to one of said compartments, for separately setting an alarm for each compartment informing the user of the time to take medication;

means for providing an alarm at the time set by the alarm setting means; and a back provided with medical information of the user.

2. The watch of claim 1, wherein the means for opening the watch face comprises a hinge lock.

3. The watch of claim 1, wherein the number of compartments is one of three or four.

4. The watch of claim 1, wherein the alarm is one of ringing, a voice message or vibration.

5. The watch of claim 1, wherein the watch comprises a wristwatch.

6. The watch of claim 1, wherein the watch comprises a pocket watch.

7. The watch of claim 1, wherein the watch comprises a chain for wearing on the neck of the user.

8. The watch of claim 1, wherein the watch comprises a bracelet with additional medication storage compartments therein.

* * * * *